United States Patent [19]

Vignon

[11] 4,290,169

[45] Sep. 22, 1981

[54] APPARATUS FOR FORMING A FIBER STRAND INTO CYCLOIDAL LOOPS

[75] Inventor: Louis Vignon, Geneva, Switzerland

[73] Assignee: Heberlein Hispano SA, Vernier-Geneva, Switzerland

[21] Appl. No.: 97,892

[22] Filed: Nov. 27, 1979

[30] Foreign Application Priority Data

Dec. 19, 1978 [CH] Switzerland ..... 12871/78

[51] Int. Cl.[3] ..... B65H 54/80

[52] U.S. Cl. ..... 19/159 R

[58] Field of Search ..... 19/159 R, 159 A; 242/82

[56] References Cited

U.S. PATENT DOCUMENTS

| | | | |
|---|---|---|---|
| 2,546,557 | 3/1951 | Naegeli | 19/159 R |
| 2,820,255 | 1/1958 | Kaiser | 19/159 R |
| 3,345,702 | 10/1967 | Miedler et al. | 19/159 R |
| 4,173,057 | 11/1979 | Vignon | 19/159 R |

FOREIGN PATENT DOCUMENTS

| | | | |
|---|---|---|---|
| 671965 | 10/1963 | Canada | 19/159 R |

*Primary Examiner*—Louis Rimrodt
*Attorney, Agent, or Firm*—William R. Hinds

[57] ABSTRACT

A cylindrical tube is inclined from the vertical below a sliver guide, the bottom end of the tube being mounted on a supporting element, and the upper part being accommodated in a bearing, the outer race of which is located in a horizontal plate. The horizontal plate has a gyratory motion imparted to it through two crankshafts, such that the tube would undergo a nutational movement. To improve the distribution of the sliver, the axis of the cycloidal loops of sliver passing from the tube is shifted by journaling the crankshafts on a second horizontal plate to which a gyratory movement is imparted by a second pair of crankshafts. The first pair of crankshafts is driven more slowly than the second pair.

6 Claims, 3 Drawing Figures

APPARATUS FOR FORMING A FIBER STRAND INTO CYCLOIDAL LOOPS

FIELD OF THE INVENTION

This invention relates to apparatus for continuously taking up a ropelike strand of fibers from a card or drawing frame, and loading the strand into a receiver, such as a spinning can, in cycloidal loops.

BACKGROUND AND SUMMARY OF THE INVENTION

There has already been proposed a device of the type generally described above, featuring a cylindrical tube inclined from the vertical below a sliver guide, the bottom end of the tube being mounted on a supporting element, and the top end or upper part being accommodated in a ball bearing, the outer race of which is located in a horizontal plate describing a gyratory movement through the action of two crankshafts coupled by drive elements, such that the tube will undergo a generally nutational movement in operation, in the sense that the tube will move in a generally conical path about its lower end. An exemplary such device is disclosed in a commonly assigned U.S. application Ser. No. 88,814 filed Oct. 29, 1979, (Schopper), entitled "Apparatus for loading a rope-like strand of fibers into spinning cans." Attention is also invited to commonly assigned earlier U.S. application Ser. No. 920,822, filed June 30, 1978, now U.S. Pat. No. 4,173,057, corresponding to Swiss Pat. No. 611,239. With such a device in operation, the sliver is piled into a can in cycloidal loops, but there is a tendency for the sliver to accumulate or concentrate in particular areas of the can in an undesired manner, the sliver typically accumulating in the center of the can. This applies in particular to the situation in which the tilted tube and the cans at the delivery end of the device are of relatively small diameters, as in feeding open-end frames.

An object of the instant invention is to remove this shortcoming in the piling operation, thereby bringing about improved distribution of the sliver in the piling operation, principally by shifting the axis of the cycloidal loops. In general, this object is met by locating the crankshafts on a second horizontal plate which also describes a gyratory movement through a second pair of coupled crankshafts, the first pair of crankshafts being driven more slowly than the second pair. Preferably the first pair of crankshafts is rotated between ten degrees and fifty degrees for every complete rotation of the second pair of crankshafts.

Other and further objects, advantages and features of the instant invention will be apparent to those skilled in the art from the ensuing description of a preferred embodiment, taken in conjunction with the appended drawing.

DESCRIPTION OF THE PREFERRED EMBODIMENT

Figure 2:
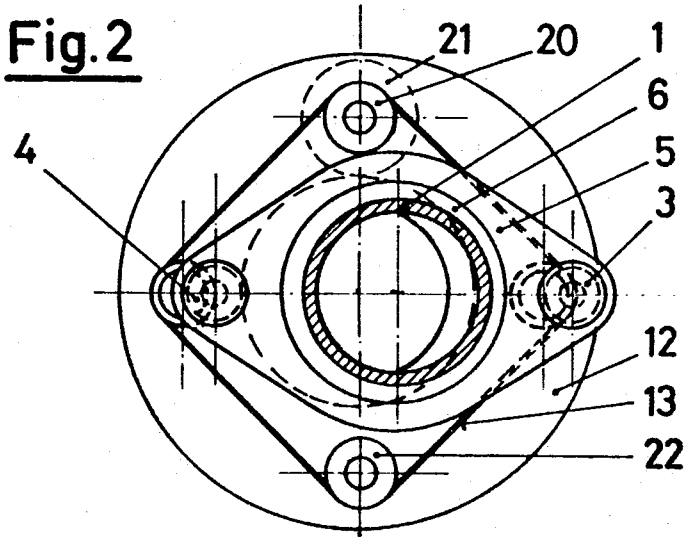
FIG. 2 is a cross-section on the line A—A of FIG. 1.

The device illustrated in the drawing comprises a cylindrical tube 1 inclined from the vertical within the machine frame 10. The bottom end of the tube 1 is supported in a cylindrical ring 2 with an inturned flange or edge, and protruding into the concentric opening in plate 11 secured to machine frame 10. The upper part of tube 1 is accommodated in a ball bearing 6, its outer race being located in plate 5.

Plate 5 is provided on opposite sides with two holes in which the upper ends of crankshafts 3 and 4 are journaled. The opposite ends of these crankshafts are journaled in plate 12, and rotated through a cog belt 13. The cog belt 13 is further guided by pulleys 20 and 22, as shown in FIG. 2. The pulley 20 is driven through a separate motor 21, e.g. a stepping motor, to rotate the two crankshafts.

Figure 3:
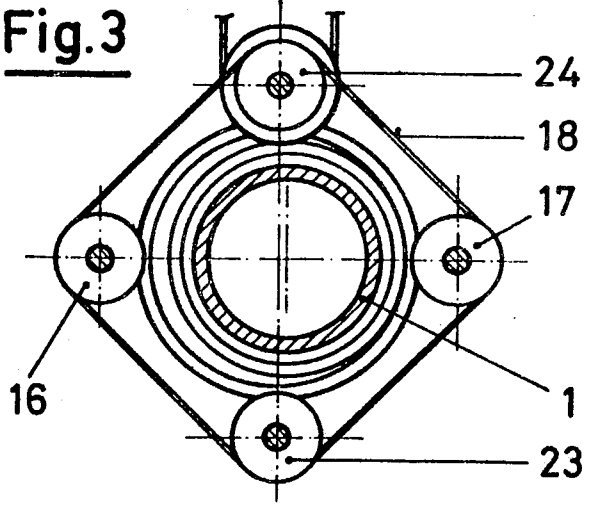
FIG. 3 shows a cross-section on the line B—B of FIG. 1.
Figure 1:
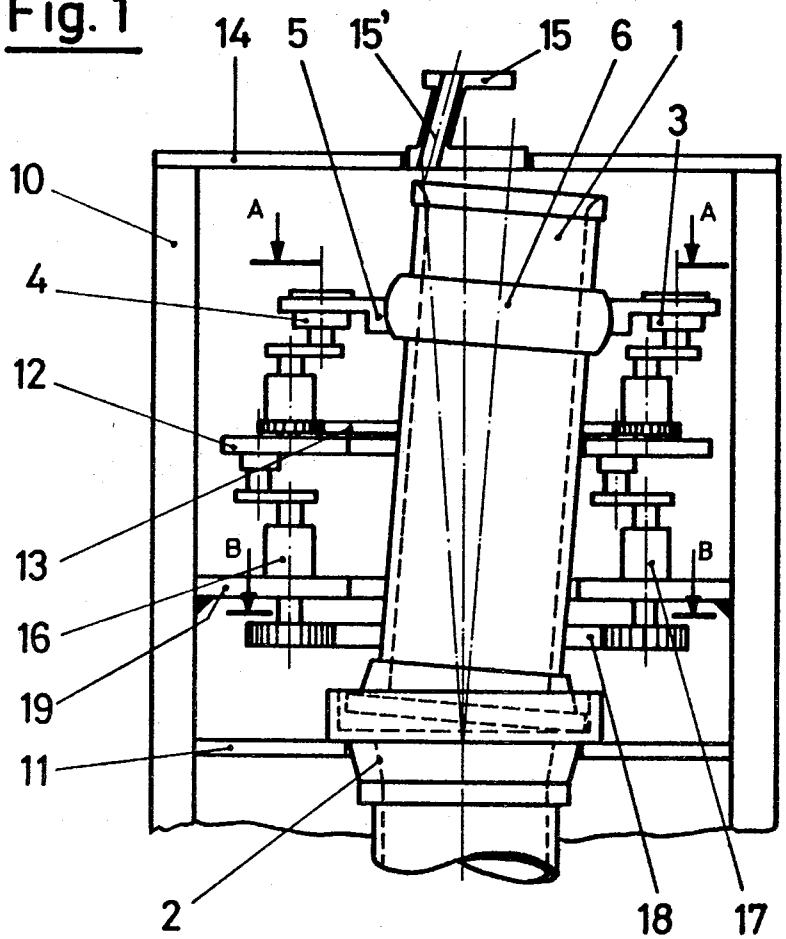
FIG. 1 shows a sectional elevation on the center line of the device, section lines being omitted for clarity.

Bearing plate 12 is further provided with two holes in which the upper ends of the second pair of crankshafts 16 and 17 are journaled. The opposite ends of these crankshafts are journaled in plate 19, which is secured to the machine frame, and crankshafts 16 and 17 are rotated through cog belt 18. As shown in FIG. 3, belt 18 is further guided by pulleys 23 and 24, the pulley 24 being synchronized with the main drive of the machine, not shown. The crankshafts 16 and 17 cause the plate 12 to describe a gyratory movement, which is superimposed upon that imparted to the plate 5 by the crankshafts 3 and 4.

The drive speeds of cog belts 13 and 18 are synchronized to the extent that for every complete revolution of crankshafts 16 and 17, crankshafts 3 and 4 rotate only from ten degrees to fifty degrees.

Mounted on machine frame 10 immediately above the top edge of tilted tube 1 is a further plate 14 having a concentric opening accommodating a rotating funnel wheel 15 of conventional design, serving to guide the sliver.

In operation of the device, the sliver (not shown) is passed through the duct 15' in the funnel 15, and piled in the tube 1 in cycloidal loops. As the gyration or rotation of the plate 5 is superimposed upon that of the plate 12, the axis of the cycloidal loops is shifted, thereby bringing about improved distribution of the sliver in the piling operation.

Having thus described a preferred embodiment of my invention as required by the statutes, I claim:

1. Apparatus for continuously taking up a ropelike strand of fibers from a card or drawing frame and loading it into a receiving container in cycloidal loops, comprising a tube inclined from the vertical with its upper end below a sliver guide and is lower end supported such that the tube can move about its lower end, first eccentric drive means coupled to said tube for imparting thereto a gyratory movement such as would cause the tube to move in a generally conical path about its lower end, and second eccentric drive means coupled to said first eccentric drive means to impart to said first eccentric drive means a gyratory movement such that the gyratory movement of said second eccentric drive means is superimposed on the gyratory movement of said first eccentric drive means, and means for driving said first and second eccentric drive means at respectively different speeds.

2. Apparatus as claimed in claim 1, wherein said first eccentric drive means is driven more slowly than the second eccentric drive means.

3. Apparatus as claimed in claim 2, wherein said first eccentric drive means comprises first generally vertically oriented crankshaft means coupled to the upper part of said tube and journaled in a member, and said second eccentric drive means comprises second generally vertically oriented crankshaft means coupled to said member for imparting gyratory movement thereto in a generally horizontal plane.

4. Apparatus as claimed in claim 3, wherein said first crankshaft means comprises a first pair of crankshafts journaled in a generally horizontal plate and having their crank arms coupled to said tube through a bearing, and said second crankshaft means comprises a second pair of crankshafts having their crank arms coupled to said generally horizontal plate.

5. Apparatus as claimed in claim 3, wherein said first crankshaft means are driven through a rotational angle of from ten degrees to fifty degrees for each complete revolution of said second crankshaft means.

6. Apparatus as claimed in claim 3, wherein said first crankshaft means are driven by a stepping motor.

* * * * *